United States Patent [19]

Strohmeier

[11] Patent Number: 4,624,646

[45] Date of Patent: Nov. 25, 1986

[54] WATER GLIDING SHOES

[76] Inventor: Helmut Strohmeier, Pötschenweg 10, A - 8605 Kapfenberg, Austria

[21] Appl. No.: 643,115

[22] Filed: Aug. 22, 1984

[30] Foreign Application Priority Data

Sep. 1, 1983 [AT] Austria ..... 3138/80

[51] Int. Cl.[4] ..... A63C 9/085

[52] U.S. Cl. ..... 441/76; 441/70

[58] Field of Search ..... 280/611, 623, 615; 441/70, 68, 65, 76, 77

[56] References Cited

U.S. PATENT DOCUMENTS 2,382,149 8/1945 Hartman ..... 441/70

3,508,288 4/1970 Lockwood ..... 441/70

FOREIGN PATENT DOCUMENTS 442431 11/1948 Italy ..... 441/70

*Primary Examiner*—Trygve M. Blix

*Assistant Examiner*—Edwin L. Swinehart

*Attorney, Agent, or Firm*—Beveridge, DeGrandi & Weilacher

[57] ABSTRACT

A binding for water gliding shoes (canoe skis) is provided with a flexible holding-down element (2) which may be placed across the instep adapting itself to the shape of the foot and stretched with its ends downward so as to press the foot against a support (1). For this purpose, the flexible holding-down element (2) is fixedly mounted on legs, on each side of the foot, of a vertically reciprocable holding-down shackle (3). The holding-down shackle (3) is preferably pivotable around an axis (4) arranged horizontally in front of the foot and transversely to the longitudinal axis of the binding. At open position of the binding, the user need only slip his instep under the flexible holding-down element (2) and pivot the holding-down shackle (3) far enough downward to obtain sufficient support and fix it in this position. The binding opens by simply pivoting the holding-down shackle (3) upward. The binding supports the foot adequately all around without shoes being required, and it is suitable for a great variety of sizes of feet and shoes. In case of fall, the foot may be pulled out from under the holding-down element (2) without having to open the binding.

13 Claims, 2 Drawing Figures

WATER GLIDING SHOES

The invention relates to a binding for water gliding shoes with a flexible holding-down element which may be placed across the instep adapting itself to the shape of the foot and stretched with its ends downward so as to press the foot against a support.

In conventional water skis, the binding usually merely consists of a holding-down element in the form of a loop into which the user inserts his toes. The traction transmitted by the tow line is sufficient for holding the foot in the binding and the foot may slip out of the loop rearward in case of a fall.

This type of binding is not suitable for water gliding shoes or canoe skis in which the skier must provide the required drive by means of a paddle. The binding must offer adequate support for the foot all around without shoes being required and should be simply adaptable to various shapes and sizes of shoes and feet. Moreover, the binding should open quickly and simply; the foot should also be able to slip out from under the holding-down element in the event of fall without the binding having to be opened; this is intended to avoid hazards arising from a binding that will not open.

U.S. Pat. Nos. 3,143,750 and 3,360,812 describe a binding for water skis of the type initially mentioned. This requires a traction cable pulling the ends of the holding-down element downward. The connection between the traction cable and the ends of the holding-down element must be made or released at each opening and closing, which is cumbersome.

It is the object of the invention to provide a binding for water gliding shoes coming up to the requirements of such a binding previously mentioned and simple to open and close. In a binding of the type initially mentioned, the invention resides in the fact that the holding-down element is fixedly mounted on the legs extending on one each side of the foot of a vertically reciprocable holding-down shackle. In the open position of the binding, i.e. at raised holding-down shackle, the user need only slip his instep under the flexible holding-down element and lower the holding-down shackle far enough to obtain adequate support and then lock it in this position. The binding is opened by simply pivoting the holding-down shackle upward. In a preferred embodiment of the binding according to the invention, the holding-down shackle is pivotable around an axis positioned horizontally in front of the foot and transversely to the longitudinal axis of the binding.

The swivelling axis of the holding-down shackle may slidably extend along a guide rod inclined rearward in the longitudinal central plane of the binding; the guide rod penetrates with play a central bore of the holding-down shackle. This permits an excellent adaptation of the inclined position of the holding-down shackle to the instep of the foot fixed by the heel.

According to another embodiment of the binding with equally good adaptability, the swivelling axis extends along a lever arm pivotable around a fixed axis of rotation.

For adaptation to various foot sizes, the lever arm is advantageously longitudinally adjustable. For this purpose, the lever arm can consist of e.g. two separate portions each formed with an external thread which can be screwed into the internal threads of various pitch of a nut part.

According to a very practical embodiment of the invention, the legs of the holding-down shackle are articulated to one each end of a tilting guide extending laterally of the foot, the other end of the tilting guide being articulated approximately in the plane of the support. It is practical to articulate a spring-tensioned pawl engaging a toothing fixed to the support on one of the tilting guides. Advantageously, a U-shaped actuating shackle is arranged in a plane approximately vertical to the plane extending through the two tilting guides; said shackle is pivotally attached by the ends of its legs to the two tilting guides with slight pivoting play and at pivoting actuation forces the pawl out of the toothing in opening direction together with the tilting guides. In this case, the binding can be closed by simply pulling the actuating shackle, which is positioned above the foot, backward, and opened by pressing the actuating shackle frontward.

The invention is explained in detail by means of an embodiment of a binding for water gliding shoes under reference to the accompanying drawings in which.

Figure 1:
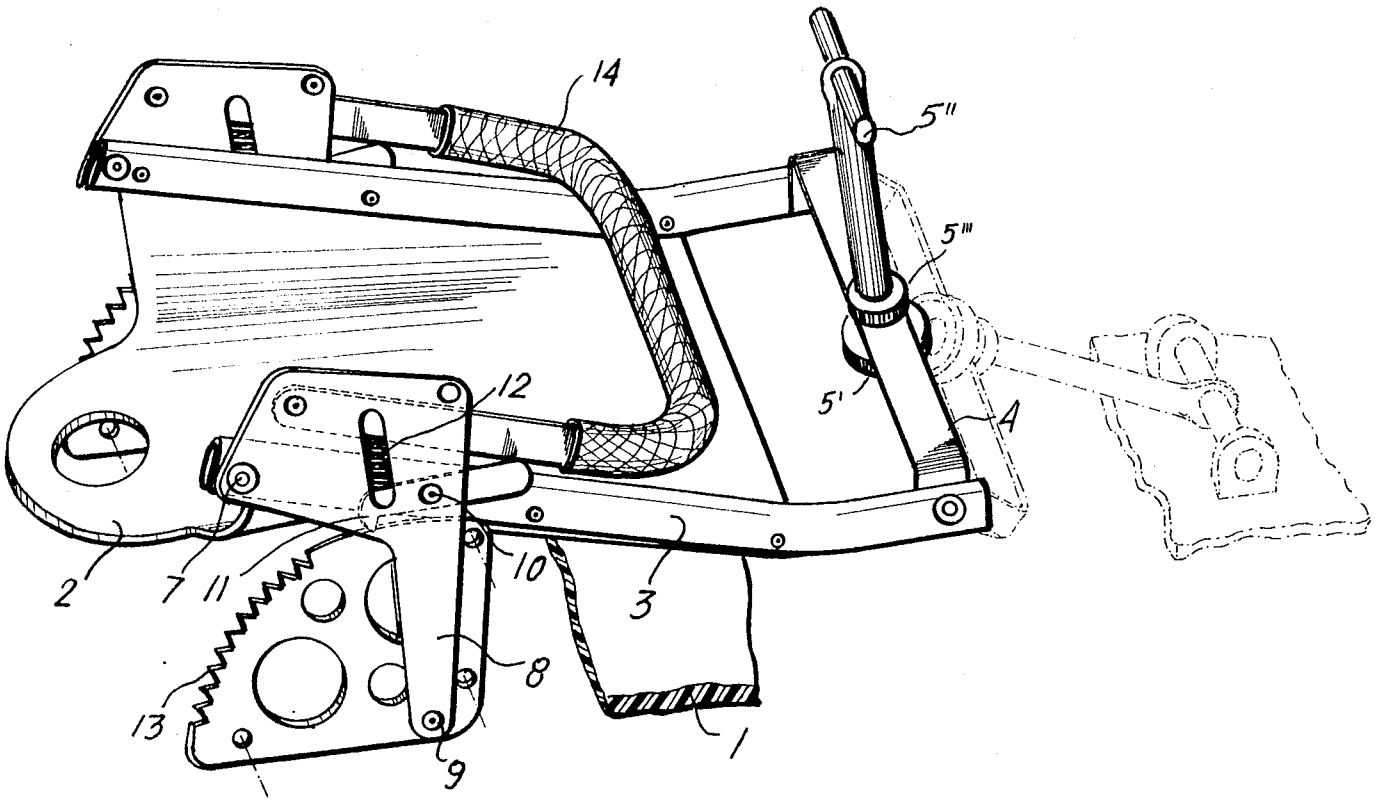
FIG. 1 shows the binding in open position without the foot.

In the drawing, the binding is represented with a base plate 1 attachable to the water gliding shoe. A holding-down element adjustable in height is provided with a part 2 placeable across the instep and made of resiliently deformable flat material, e.g. rubber, and it stretchable with its ends downward adapting itself to the shape of the foot so as to press the foot against a support in the form of the base plate 1. The holding-down element 2 which is stretchable across the instep is attachable for this purpose on its ends by means of clamping strips, of which only the screws fixing them are shown in the drawing, on the legs of a U-shaped holding-down shackle 3 extending on either side of the foot. The holding-down shackle 3 is pivotable up and down around a swivelling axis 4 arranged horizontally in front of the foot and transversely to the longitudinal axis of the binding.

The swivelling axis 4 (in an embodiment in detail not shown in the drawing) can be slidably fixed along a guide rod inclined rearward in the central longitudinal plane of the binding. For this purpose, the holding-down shackle is provided on its front with a central bore penetrated with play by the longitudinal guide rod. The play is necessary so as to permit the pivoting of the holding-down shackle 3 around the swivelling axis 4 in opening and closing the holding-down means 2, 3.

Figure 2:
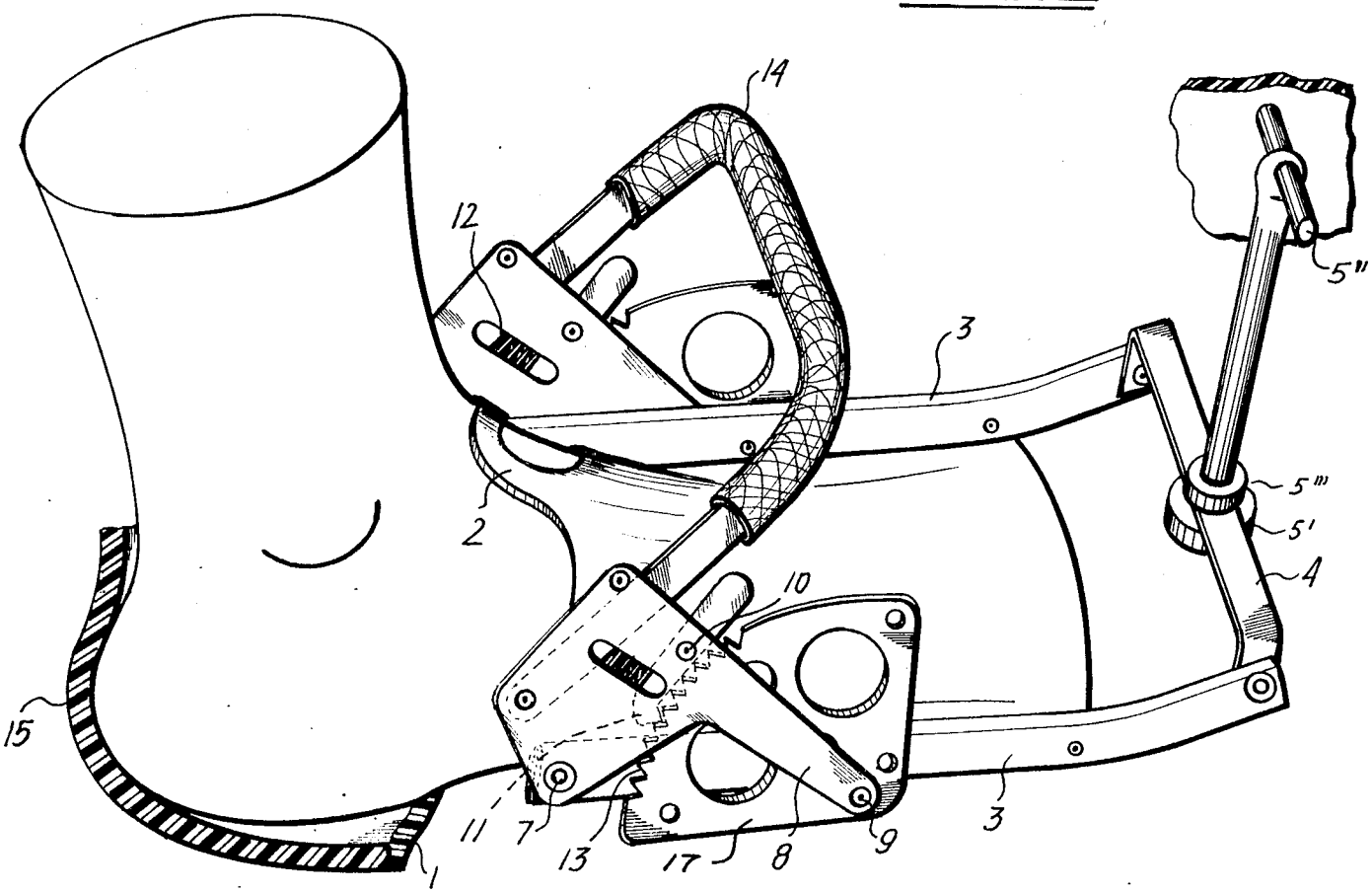
FIG. 2 shows the binding in the position closed on the foot, each in perspective view.

FIGS. 1 and 2 show in full lines an embodiment in which the longitudinal guide rod supporting the swivelling axis 4 is replaced by a lever arm 5' pivotable around a fixed axis of rotation 5'' positioned above the swivelling axis 4. When opening and closing the holding-down aeans 2, 3, the swivelling axis in this variant describes an orbit with its center in the axis of rotation 5''. Furthermore, the lever arm 5' is adjustable in length for adapting the holding-down means 2,3 to various foot sizes. For this purpose, the lever arm consists of two separate portions each formed with an external thread screwed into interior threads of various pitch of a screw-nut-part 5'''. By turning the screw-nut-part 5''', the length of the lever arm 5' and the position of the orbit of the swivelling axis 4 can be changed. The structural elements replacing the longitudinal guide rod in the last-mentioned variant bear the reference number 5 in FIGS. 1 and 2, but are supplemented by one or more apostrophies.

The legs of the U-shaped holding-down shackle 3, which is positioned with its front portion approximately in the plane of the base plate 1, are articulated rearward at 7 (knuckle pin) at one each end of a tilting guide 8 extending laterally of the foot. The other (lower) end of the tilting guide 8 is articulated at 9 approximately in the plane of the base plate 1.

A pawl 11 is articulated on one of the tilting guides 8 (at 10) and kept engaged by means of a spring 12 in a toothing 13 on element 17. Tilting guide 8 is hingedly attached via pivot 9 to element 17.

A U-shaped actuating shackle 14 attached with the ends of its legs to the two tilting guides 8 is arranged in a plane approximately vertically in relation to the plane extending through the two tilting guides. FIG. 1 shows the actuating shackle 14 in this position pressed forward, with the tilting guides 8 in an upright position and the holding-down means 2,3 in open position. In this open position, the holding-down shackle 3 is with its swivelling axis 4 frontmost and with its ends attached to the tilting guides 8 in the highest possible position. In the open position, the skier can slip his foot under the holding-down means 2,3 or withdraw it from there.

FIG. 2 shows the actuating shackle 14 in its position pulled backward, with the tilting guides 8 pivoted around axis 9 rearward and the holding-down means 2,3 in closing position. In this closing position, the holding-down means 2,3 is positioned with its swivelling axis 4 farthest rearward and with its ends attached to the tilting guides 8 as low down as the holding-down eleaent 2 stretched across the instep permits this.

The actuating shackle 14 is pivotable with slight play in relation to the tilting guides 8. This pivoting play is limited by the pawl 11 in clockwise direction in the Figures. Knuckle pin 7 connects the tilting guides 8 to the holding-down shackle 3. In the pivoting motion of the actuating shackle 14 in opening direction together with the tilting guides 8, the actuating shackle 14 (as particularly shown in FIG. 1) forces the pawl 11 out of the toothing 13.

A fixed heel trough part 15 formed to the base plate 1 offers the foot an abutment against the closed holding-down means 2,3.

I claim:

1. Binding for supporting a foot on a foot-supporting surface of a water gliding shoe, said binding comprising vertically reciprocable holding-down means with a flexible instep-engaging portion stretchable across the instep adapting itself to the shape of the foor and pressing the foot against a support in a depressed position of the holding-down means; wherein the holding-down means is arrestable in various vertical positions as for adaption to foot size or holding strength desired by a user;

wherein the holding-down means is fixedly mounted on legs adapted to straddle the foor and the legs are joined to a vertically reciprocable holding-down shackle;

wherein the holding-down shackle is pivotable around a swivelling axis arranged horizontally in front of the foot and transversely to a longitudingal axis of the binding; and wherein the swivelling axis extends on a guide rod pivotable around a fixed axis of rotation.

2. Binding according to claim 1, wherein the guide rod is adjustable in length.

3. Binding according to claim 1, wherein the swivelling axis slidably extends along said guide rod, which guide rod penetrates with play a central bore of the holding-down shackle.

4. Binding according to claim 1, wherein each of the legs of the holding-down shackle is articulated rearward on one end of a tilting guide, which tilting guide extends longitudinally of the foot, the other end of the tilting guide being pivotally attached to the support.

5. Binding according to claim 1, wherein each of the legs of the holding-down shackle is articulated rearward on one end of a tilting guide, which tilting guide extends longitudinally of the foot, the other end of the tilting guide being pivotably attach to the support.

6. Binding according to claim 2, wherein each of the legs of the holding-down shackle is articulated rearward on one end of a tilting guide, which tilting guide extends longitudinally of the foot, the other end of the tilting guide being pivotably attach to the support.

7. Binding according to claim 3, wherein each of the legs of the holding-down shackle is articulated rearward on one end of a tilting guide, which tilting guide extends longitudinally of the foot, the other end of the tilting guide being pivotably attach to the support.

8. Binding according to claim 4, wherein a spring-tensioned pawl engaging a toothing fixed to the support is articulated to one of the tilting guides.

9. Binding according to claim 8, wherein a U-shaped actuating shackle is arranged in a plane extending through the two tilting guides, which actuating shackle is pivotally movable on the two tilting guides with slight pivot play and in pivoting actuation forces the pawl out of the toothing.

10. Binding for mounting on a foot-supporting surface of a water gliding shoe, said binding comprising a flexible, instep-engaging portion vertically movable above said surface and adapted to receive a foot, wherein said flexible portion is stretchable across the instep of the foot and is capable of assuming a shape corresponding to the shape of the foot;

holding-down means attached to said flexible portion for raising and lowering said flexible portion over the foot;

wherein the flexible portion can be lowered by the holding-down means to press the foot against the surface thereby firmly holding the foot against the surface;

and wherein the holding-down means is arrestable in a multiplicity of vertical positions to adapt the shoe to foot size and to control holding-down force on the foot;

wherein said flexible portion is attached to two vertically reciprocal legs, one leg on each side of the foot, and the vertical legs are hinged in front of the foot such that the legs and flexible portion move angularly upward and downward over the foot and surface;

wherein each leg is pivotally joined to one end of a tilting guide, which tilting guide extends longitudinally of the foot, and wherein the other end of said tilting guide is adapted to be attached to the plane of the surface;

a tooth-carrying element on each side of the foot, wherein each element has a multiplicity of vertically spaced teeth, and wherein the element is adapted for connection to the surface;

means for rotatably attaching each of said tilting guides to one of said tooth-carrying elements;

a spring-tension pawl rotatably attached to each tilting guide, wherein said pawl is capable of engaging the teeth in said tooth-carrying element to arrest vertical movement of said legs.

11. Binding for mounting on a foot-supporting surface of a water gliding shoe, said binding comprising two vertically reciprocal, substantially parallel legs adapted to straddle a foot;

means for hinging said legs in front of the foot so that the legs move angularly upward and downward over the surface;

a flexible, instep-engaging portion secured to each of said legs and vertically movable above said surface and adapted to receive the foot, wherein said flexible portion is stretchable across an instep of the foot and capable of assuming a shape corresponding to the foot, and wherein the flexible portion can be lowered by lowering the legs to press the foot against the surface thereby firmly holding the foot against the surface;

means for arresting the legs in a multiplicity of vertical positions to adapt the shoe to foot size and to control holding-down force on the foot;

an upstanding tooth-carring element adjacent each leg, wherein each element has a multiplicity of vertically spaced teeth, and wherein each element is adapted for connection to the surface;

an upstanding tilting guide extending laterally of each leg;

first pivot means for pivotally joining each tilting guide to an adjacent leg;

second pivot means spaced apart from said first pivot means for pivatally joining each tilting guide to an adjacent tooth-carrying element; and a spring-tension pawl rotatably attached to each tilting guide, wherein said pawl is capable of engaging the teeth in said tooth-carrying element to arrest vertical movement of said legs in various positions to adapt the shoe to foot size and to control holding-down force on the foot.

12. Binding according to claim 11 comprising shackle means over said flexible portion;

third pivot means for pivotally joining said shackle means to each of said tilting guides so that said shackle can be angularly raised or lowered over said flexible portion, wherein said third pivot means is spaced apart from each of said first and second pivot means.

13. Binding according to claim 12, wherein said shackle is adapted to contact each pawl to force the pawl out of the teeth on the tooth-carrying elements.

* * * * *